United States Patent [19]

Dunbar

[11] 4,126,963

[45] Nov. 28, 1978

[54] TREE STAND FOR SUPPORTING AND WATERING A LIVE TREE

[75] Inventor: Bruce A. Dunbar, Huntington Beach, Calif.

[73] Assignee: Alvis Harold Dunbar, Fresno, Calif.

[21] Appl. No.: 783,179

[22] Filed: Mar. 31, 1977

[51] Int. Cl.[2] ..... A47G 33/12

[52] U.S. Cl. ..... 47/40.5; 248/146; 248/523

[58] Field of Search ..... 47/40.5; 248/511, 519, 248/521, 523-529, 146, 150

[56] References Cited

U.S. PATENT DOCUMENTS

| | | | |
|---|---|---|---|
| 1,005,750 | 10/1911 | Schwaderer | 248/529 X |
| 1,421,340 | 6/1922 | Zelazo | 47/40.5 |
| 1,562,758 | 11/1925 | Hanson | 248/150 |
| 2,044,192 | 6/1936 | Templin, Jr. | 47/40.5 |
| 2,609,169 | 9/1952 | Kroeger | 47/40.5 |
| 2,613,010 | 10/1952 | Atkinson | 248/146 X |
| 2,655,331 | 10/1953 | Merritt | 248/528 X |
| 2,733,032 | 1/1956 | Farley et al. | 47/40.5 |
| 2,746,700 | 5/1956 | Barbera | 47/40.5 |
| 2,786,641 | 3/1957 | Applegate | 248/523 |
| 2,893,668 | 7/1959 | Applegate | 47/40.5 X |
| 2,994,498 | 8/1961 | Sager | 47/40.5 |
| 2,997,264 | 8/1961 | Zelenitz | 248/529 X |
| 3,033,505 | 5/1962 | Brown | 47/40.5 |
| 3,119,585 | 1/1964 | Austenson | 248/529 X |
| 3,142,464 | 7/1964 | Zelenitz | 47/40.5 |
| 3,232,567 | 2/1966 | Mastenbrook | 248/529 X |
| 3,272,462 | 9/1966 | Apple | 47/40.5 |
| 3,719,340 | 3/1973 | Norton | 248/529 X |
| 3,862,733 | 1/1975 | Sullivan | 248/529 |

FOREIGN PATENT DOCUMENTS

| | | | |
|---|---|---|---|
| 71,724 | 10/1893 | Fed. Rep. of Germany | 248/523 |
| 78,892 | 12/1962 | France | 248/146 |

*Primary Examiner*—Edgar S. Burr
*Assistant Examiner*—Steven A. Bratlie

[57] ABSTRACT

A live tree whose trunk has been cut from its roots is supported on a stand and continuously watered from a vessel associated with the stand. A conical hole is drilled into the cut end of the tree trunk. A tapered peg is inserted into that hole. The external surface of the peg is not circular, but has longitudinally extending ridges which engage and bite into the wall of the hole. The lower end of the peg is supported in a water vessel. The cut end of the tree trunk is immersed in water around its circumferential surface, on the end grain of its cut end, and water also flows upward along the surface of the peg between the longitudinal ridges thereon in contact with the wall of the conical hole.

9 Claims, 19 Drawing Figures

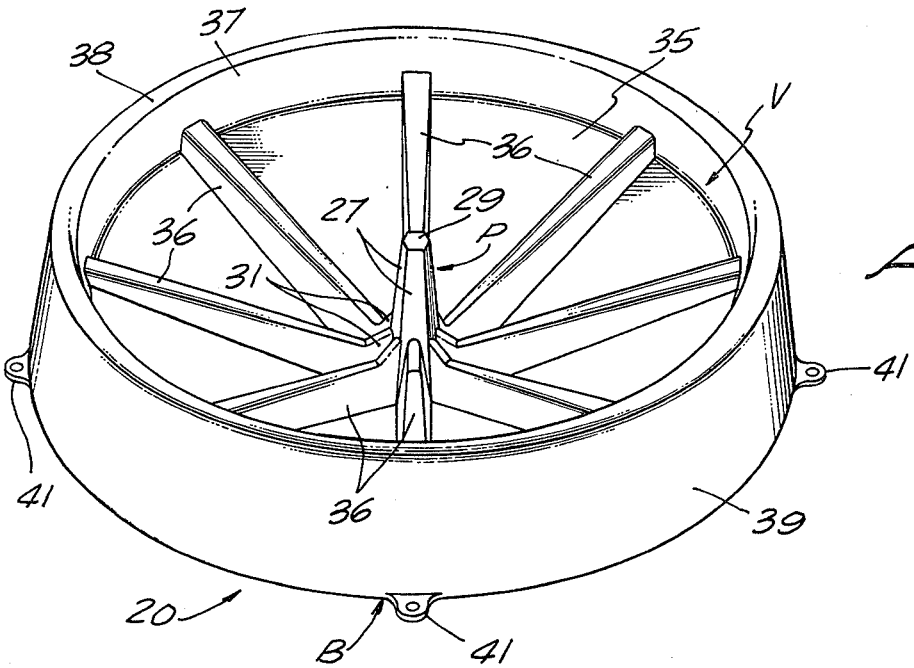
FIG. 1.
FIG. 2.
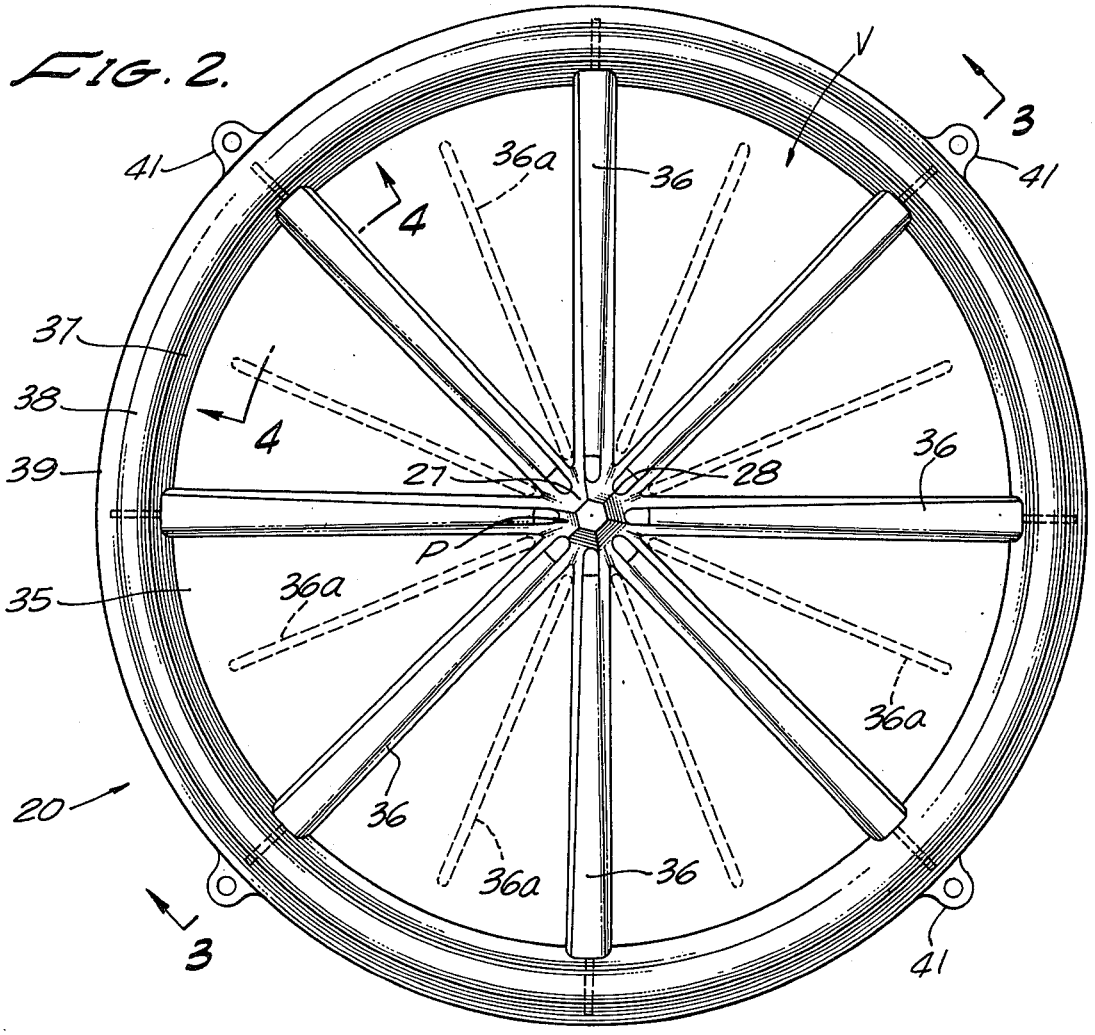

FIG. 16.
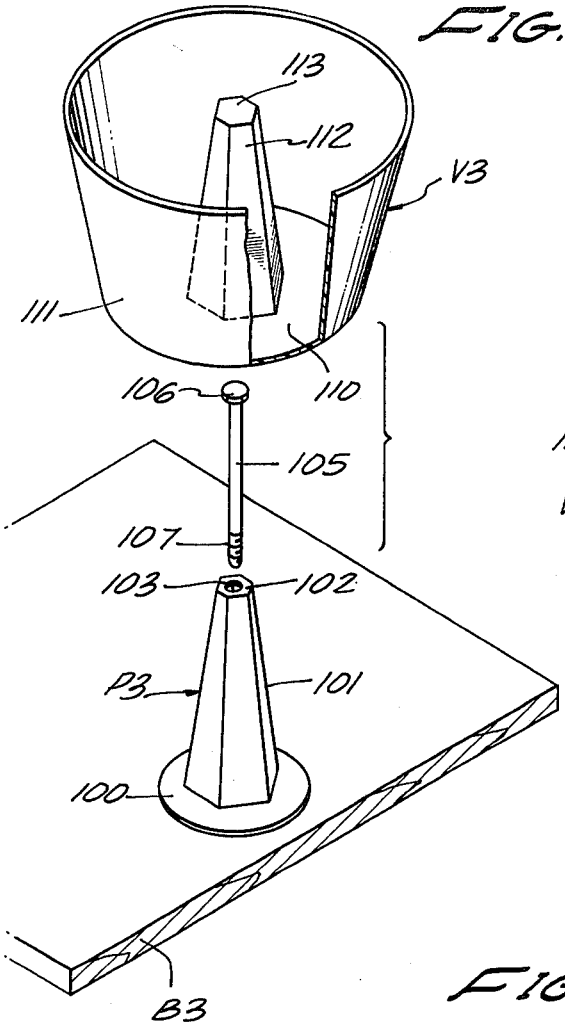
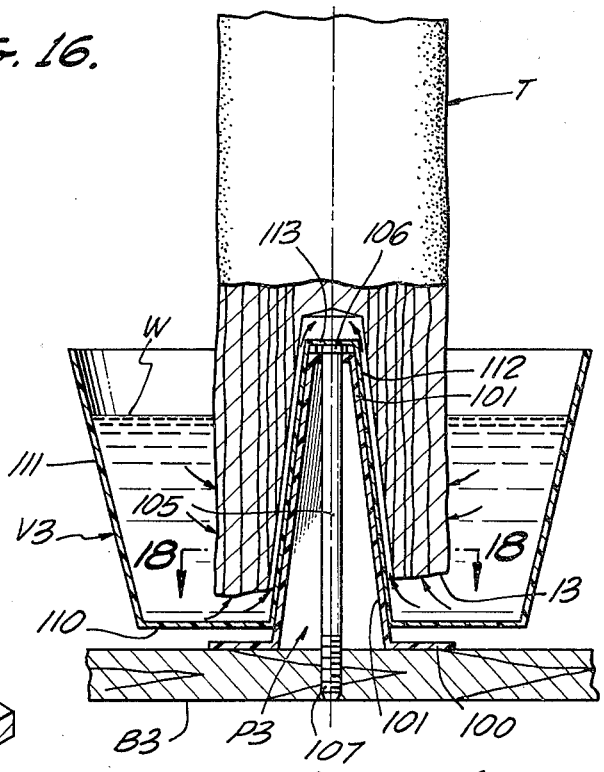
FIG. 17.
FIG. 18.
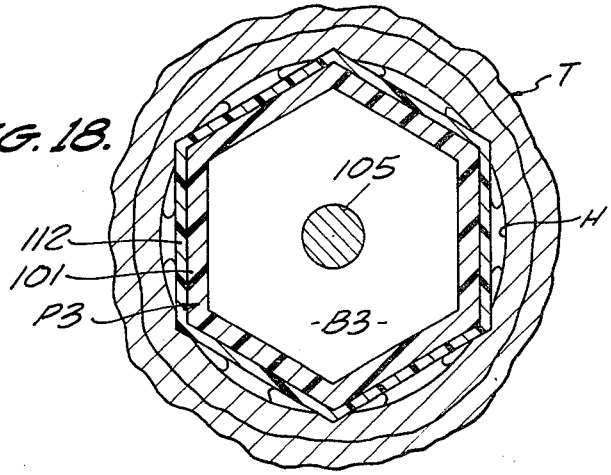
FIG. 19.
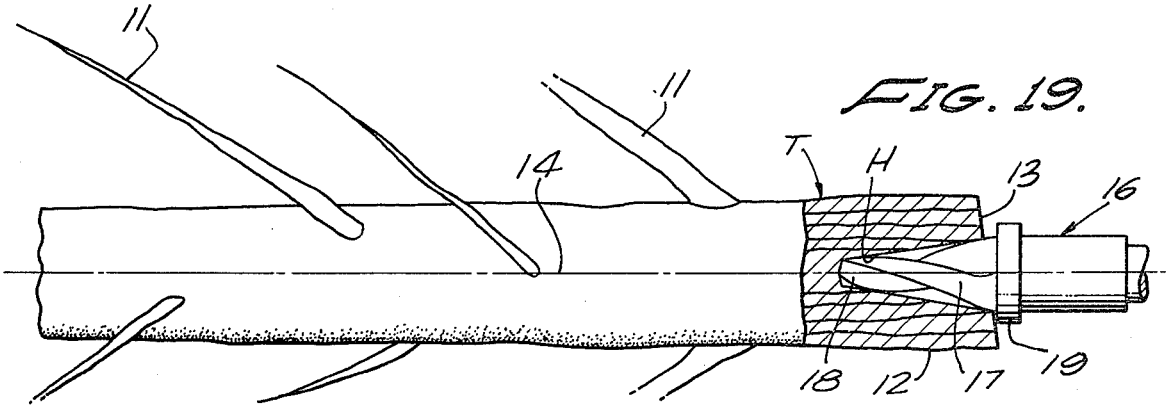

TREE STAND FOR SUPPORTING AND WATERING A LIVE TREE

BACKGROUND OF THE INVENTION

The problems involved in handling live Christmas trees are well-known. The trees are generally cut from a forest and transported long distances into cities where they are displayed and sold over a period of time. Very often by the time the trees are sold they have become so dry that they constitute a fire hazard. The purchaser then places the tree in his home, supported on an appropriate stand, for some additional period of time. Various methods have been used for supplying water to the tree after it has been cut, in order to keep it alive and healthy, but none of those methods have been particularly effective.

Therefore, the object and purpose of the present invention is to provide an apparatus and method for supporting and providing a continuous water supply to a living tree after it has been cut, and which method is both economically effective and convenient to use.

SUMMARY OF THE INVENTION

One principal feature of the present invention is an extremely simple, but yet mechanically effective, method for supporting a living tree whose trunk has been cut from its roots. A conical hole is drilled in the cut end of the tree trunk. A tapered peg is selected, having an angle of taper which is comparable to the angle of taper of the conical hole in the tree trunk, and preferably identical thereto. The narrow end of the peg is cut off or truncated, so that when the peg is driven into the hole in the tree trunk it can be driven far enough to radially compress the wood along the circumferential wall of the conical hole. The tapered peg is made long enough so that its large end also protrudes beyond the cut end of the tree trunk. The large end of the peg is then attached to a supporting base. By means of this simple mechanism the tree is firmly supported, entirely from the interior wall of the conical hole in its trunk, and in a properly aligned vertical position.

An important refinement of the invention is to provide the tapered peg with a circumferential surface which is not precisely circular, but instead has raised surface portions which provide at least three longitudinally extending ridges. When the peg is driven into the conical hole in the tree trunk these ridges bite into the surface of the wood and ensure both the positive support and correct alignment of the tree.

As a further feature of the invention, a liquid vessel is provided which surrounds the lower portion of the peg and is filled with water and perhaps with other liquid nutrients as well. The body of water is then in direct contact with the circumferential surface of the lower end of the tree trunk, and it is also in direct contact with the end grain of the cut end of the trunk, since the peg is long enough to prevent the cut end of the tree trunk from extending down into contact with the supporting base. Furthermore, the intervening spaces between the ridges on the peg provide pathways along which the water moves upwardly into the interior of the conical hole in the tree trunk.

Another feature of the invention is to construct the supporting base, liquid vessel, and peg as an integral structure, preferably from plastic material.

According to an alternate form of the invention the liquid vessel, peg, and a portion of the supporting base are integrally formed of plastic material, and the remainder of the supporting base is provided by detachable legs, which limit the size of the package required to store or transport the device.

According to a further alternate form of the invention the supporting base that is used is simply a wooden board, which may be obtained from any convenient source. The peg is then specifically designed so that it may be conveniently and securely fastened to the board. The liquid vessel is then formed as a separate component, so shaped that it may be removably supported upon the peg. Furthermore, in this form of the invention the pegs are hollow, so that a large number of them may be conveniently nested together for purpose of storage and transport. Also, the liquid vessels are of such configuration that a large number of them may be nested together for purpose of convenient storage or transport.

DRAWING SUMMARY

FIG. 1 is a perspective view of a tree stand and watering apparatus in accordance with the invention;

FIG. 2 is a top plan view of the device of FIG. 1;

FIG. 16 is a perspective view of a third main embodiment of the invention, characterized by a separate liquid vessel which is removably supported on the peg;

FIG. 17 is a cross-sectional elevational view of the device of FIG. 16 showing a tree trunk supported thereon and the liquid vessel filled with water;

FIG. 18 is a horizontal cross-sectional view of the tree trunk and peg, as well as the intervening portion of the liquid vessel, taken on the line 18—18 of FIG. 17; and FIG. 19 is a view, partially in cross-section, of a tree trunk showing a conical hole being drilled in its cut end.

CUTTING THE TREE TRUNK

Figure 3:
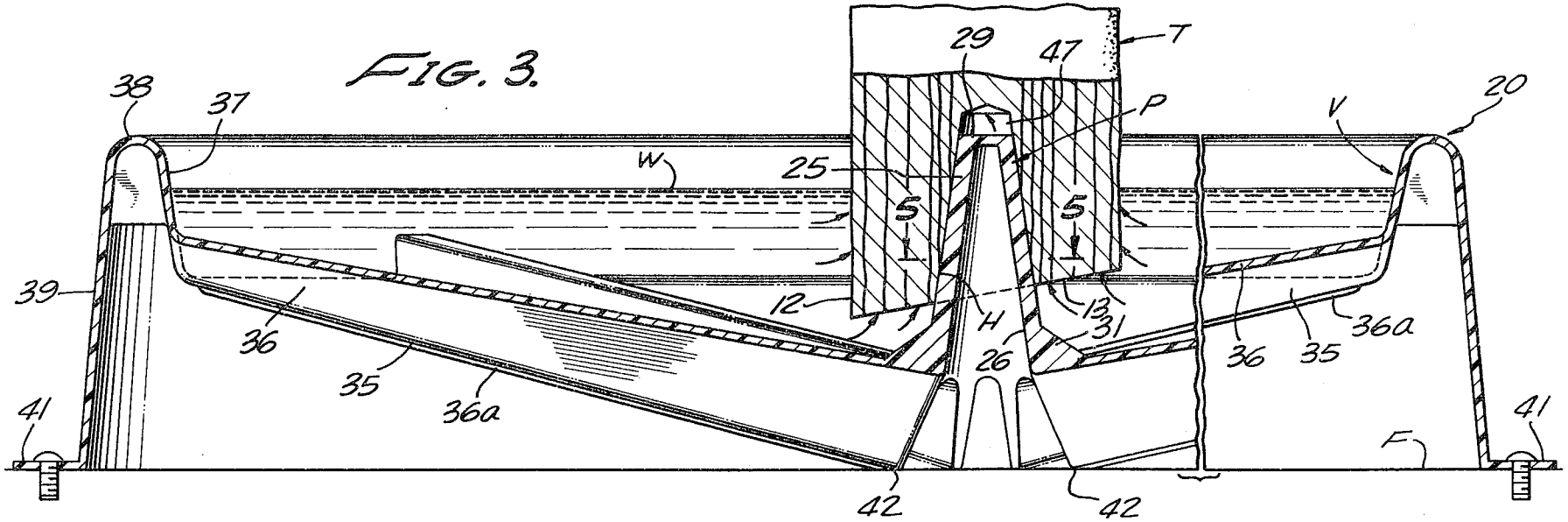
FIG. 3 is a cross-sectional elevational view of the device taken on the line 3—3 of FIG. 2, on an enlarged scale, and showing the trunk of a tree being supported on the device and the liquid vessel of the device being filled with water.

Reference is made to FIG. 19 of the drawings which illustrates the method of cutting the tree trunk in accordance with the present invention.

The tree trunk T has a number of upwardly extending branches 11, shown only in part. Near its base end it has a circumferential surface 12 which is of substantially cylindrical configuration and is free of any branches. The lower end of the trunk is cut along a flat face 13, which is a rather inevitable result of the present procedure of sawing the tree trunk free of its root structure. It will be noted that while the sawed end surface 13 is rather precisely flat, it is not precisely perpendicular to the generally cylindrical circumferential surface 12. Nor is it precisely perpendicular to a dotted line 14 that indicates the longitudinal axis of the tree.

Figures 11, 12, 13, 14, 15:
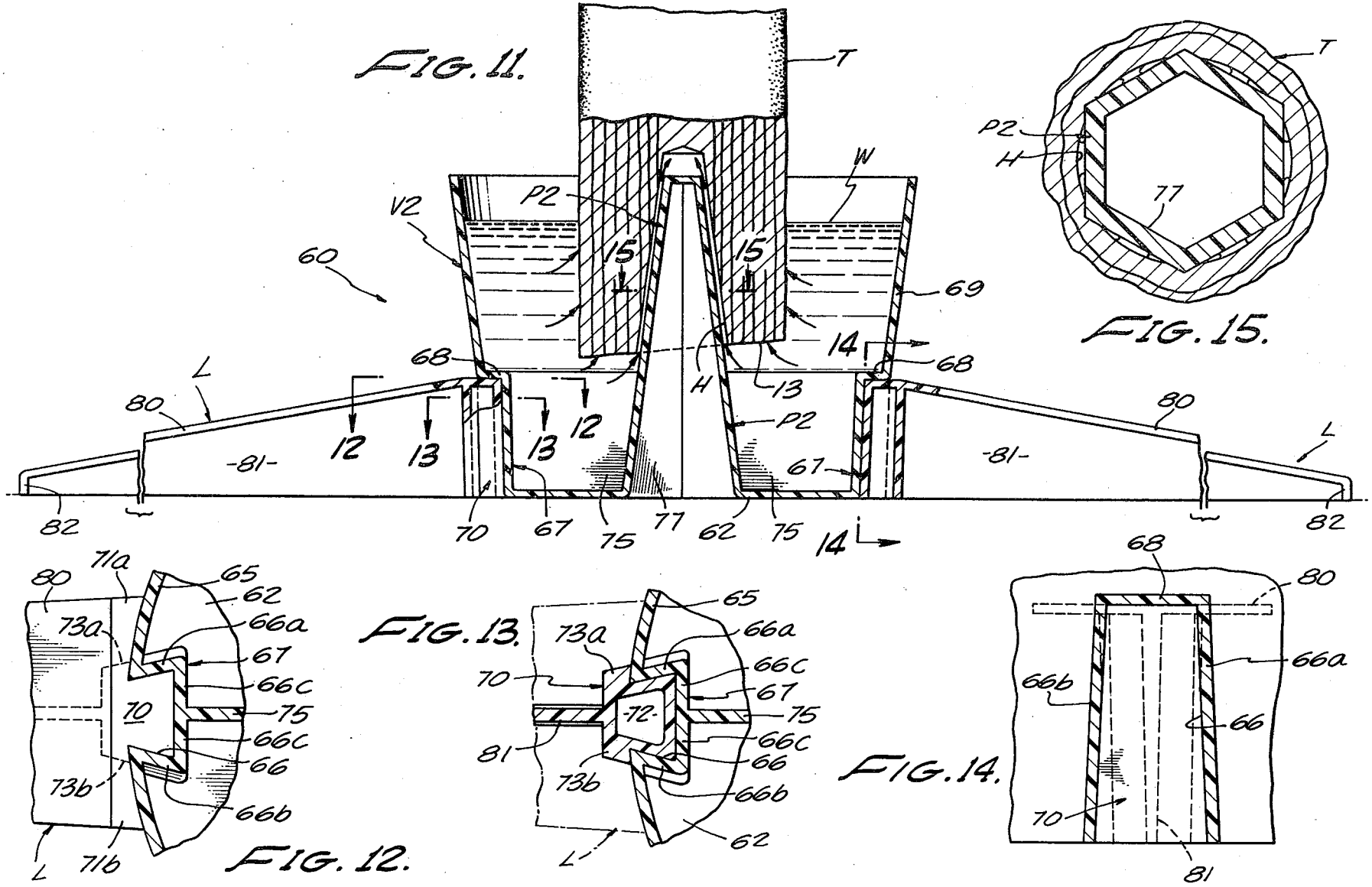
FIG. 11 is a cross-sectional elevational view of the tree stand of FIG. 8, taken along the line 11—11 of FIG. 10, on an enlarged scale, and showing a tree trunk supported on the peg of the device and the liquid vessel of the device filled with water.
FIG. 12 is a top plan view of one of the leg joints of the device of FIG. 8, taken on the line 12—12 of FIG. 11.
FIG. 13 is a horizontal cross-sectional view of the leg joint of FIG. 12 taken on the line 13—13 of FIG. 11.
FIG. 14 is a cross-sectional elevational view of one of the leg joints, on an enlarged scale, taken on the line 14—14 of FIG. 11.
FIG. 15 is a horizontal cross-sectional view of the tree trunk and peg taken on the line 15—15 of FIG. 11.

The illustration in FIG. 19 and also in FIGS. 3, 11, and 17, has been deliberately chosen to emphasize the fact that the sawed or cut end of the tree trunk may depart considerably from a perpendicular relationship to the longitudinal or vertical axis 14 of the tree. Thus, if the tree were to be supported simply by resting it upon the cut end surface 13 of its trunk, it would tilt significantly to one side. Alternatively, the flat end surface could be recut in an effort to make it precisely square, before nailing a wooden stand onto the bottom end of the tree in a manner that has been well-known and widely used.

In accordance with the present invention, however, it is immaterial that the cut end 13 may depart from the perpendicular relationship to the vertical axis 14 of the tree. Nor is it necessary to recut the end. A drill 16 having a conically shaped bit 17 with a dull or truncated forward end 18 is placed in precise longitudinal alignment with the longitudinal axis 14 of the tree. Then a conically shaped hole H is cut into the tree trunk, the depth of the cut being limited by a shoulder 19 on the drill 16 which acts as a stop and prevents the drill from drilling too deeply into the tree trunk.

According to the present invention the longitudinal axis 14 of the tree need not necessarily conform to one specific definition. For example, the axis 14 may be selected as the straight line which extends from the center of the lower end of the tree trunk to the center of the uppermost tip of the trunk portion of the tree. Or it may be selected as the line which, when placed in a precisely vertical position, will cause the tree to be balanced when supported at the particular point on its lower end surface 13 through which that line 14 passes. Or alternatively, the vertical axis 14 may be selected on the basis of what appears to present an artistically balanced configuration of the branches of the tree on the respective sides of that line. But in any event, according to the present invention it is contemplated that the axis line 14 of the tree will be determined according to one criteria or another, and the drill 16 will be used to drill a conical hole H which is concentric to that axis 14, toward the end that the tree will be correctly supported when it is attached to its stand. The angular width of hole H is preferably 14°.

FIRST EMBODIMENT

(FIGS. 1–6)

Reference is now made to FIGS. 1–6, inclusive, of the drawings illustrating one embodiment of the novel tree stand provided in accordance with the present invention.

The tree stand 20 shown in perspective in FIG. 1 is integrally formed from a single piece of plastic material. In general, the stand 20 includes an upwardly opening liquid vessel V of generally bowl-shaped configuration, a peg P which is supported in an upstanding position at the center of the bowl, and a supporting base B. The peg P will be described first.

Figure 6:
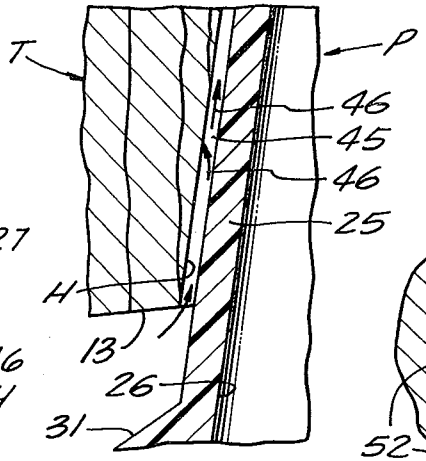
FIG. 6 is a fragmentary cross-sectional elevational view of the peg and tree trunk taken on the line 6—6 of FIG. 5.

As best seen in FIGS. 1, 3, and 6 the peg P is tapered with its smaller end extending upwardly. Its circumferential wall 25 (FIG. 5) has an interior wall surface 26 which is circular as seen in cross-section in FIG. 5 but is tapered as seen in vertical cross-section in FIG. 3. Thus the interior wall surface of the peg has a conical configuration. On its outer surface, however, the peg is of hexagonal cross-sectional configuration, having six flat surfaces 27 which are of equal size, each being wider at the bottom end of the peg and relatively narrow at its top end. A set of six ridges or corners 28 are formed by the adjoining edges of adjacent ones of the flat surfaces 27. Thus, the peg P has six of the ridges 28, all of which are inclined at an angle relative to the longitudinal vertical axis of the peg. The upper or narrow end of the peg is cut off or truncated and is enclosed or covered by a flat upper end wall 29, FIG. 3. At its lower end the circumferential wall 25 of the peg is thickened at 31, as seen in FIGS. 3 and 6, with the thickening being in the form of additional plastic material on the outer side of the wall which causes the base portion of the peg to fan outward to a larger diameter than it would otherwise have.

Figure 4:
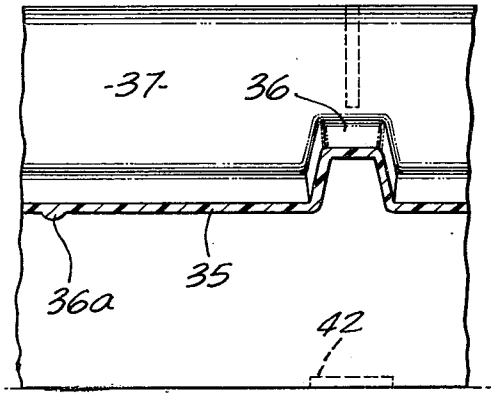
FIG. 4 is a fragmentary cross-sectional view of the radial rib structure taken on the line 4—4 of FIG. 2.
Figure 8:
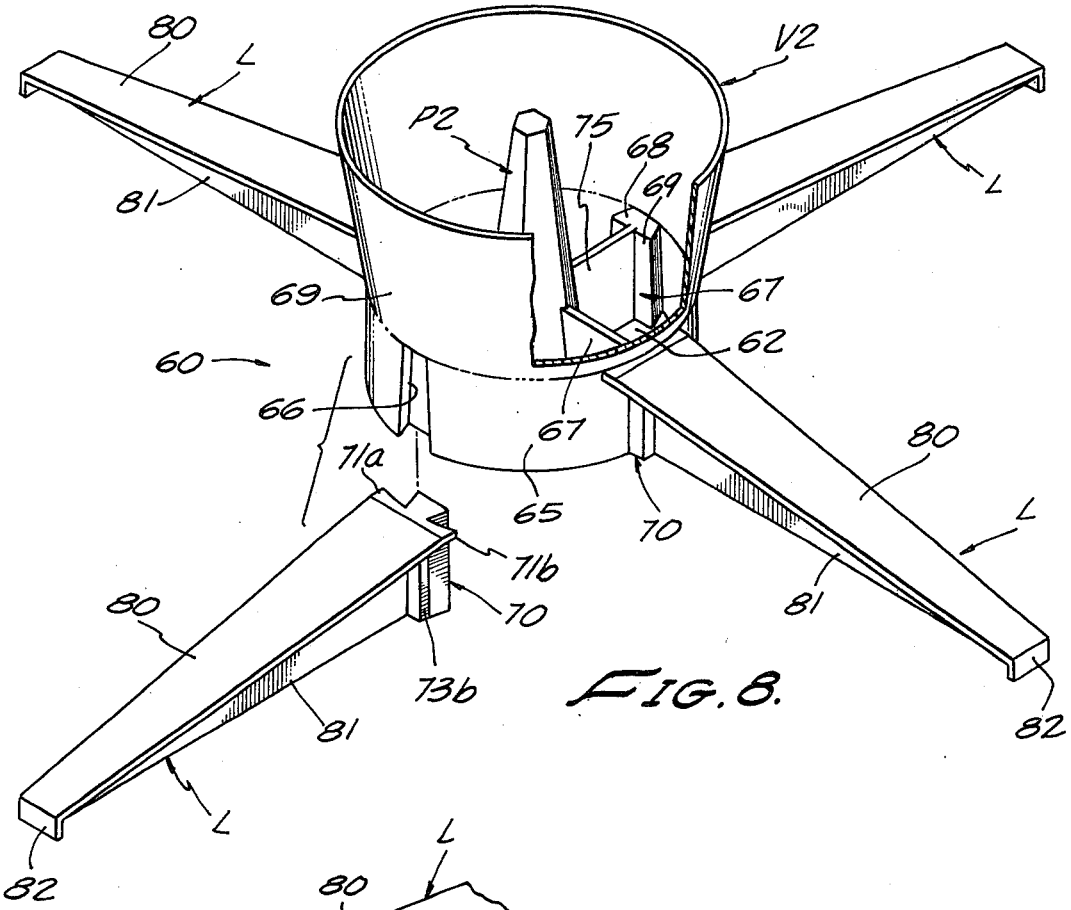
FIG. 8 is a perspective view of another tree stand in accordance with the invention, having removable legs.
Figure 9:
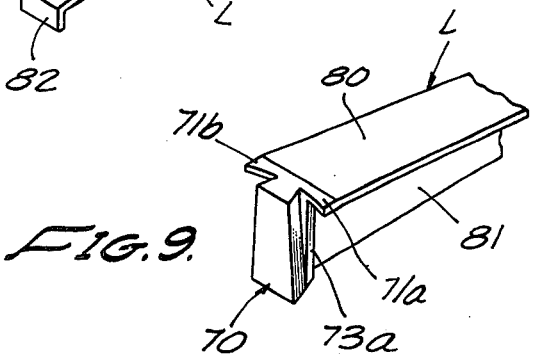
FIG. 9 is a perspective view of the joining end of one of the removable legs of FIG. 8.
Figure 10:
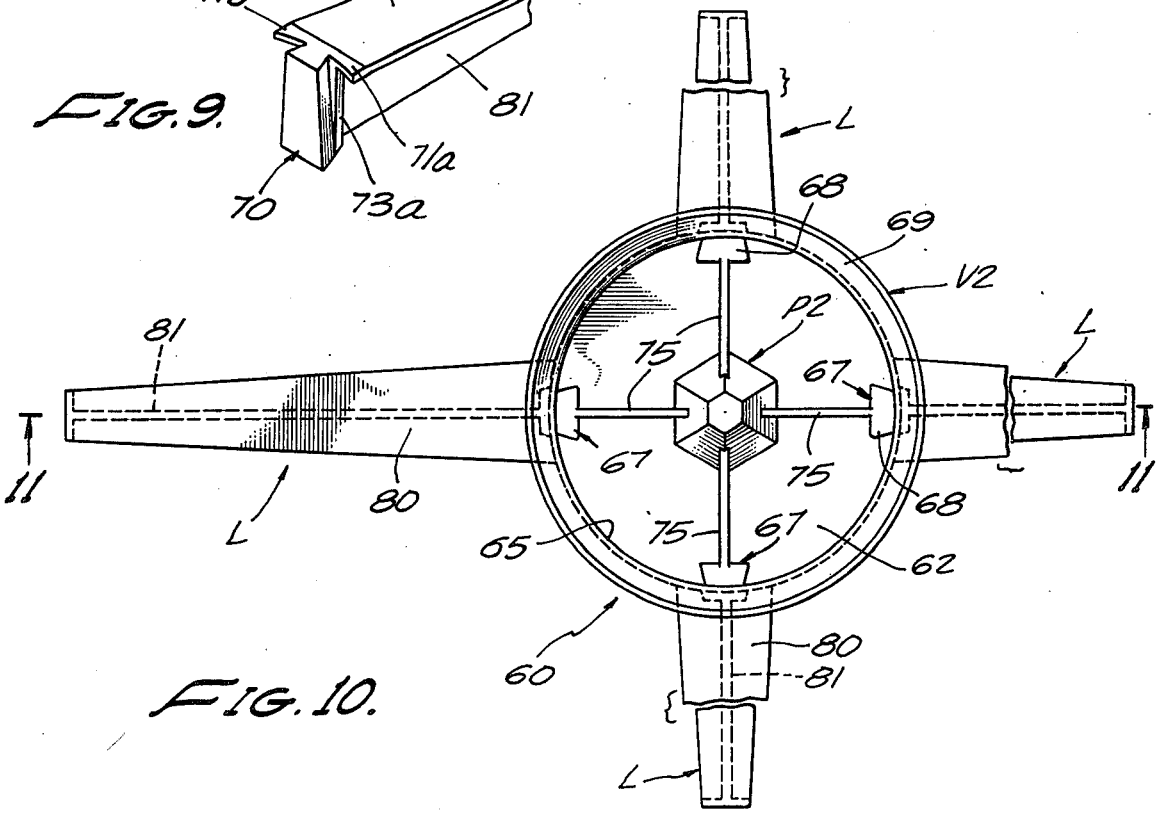
FIG. 10 is a top plan view of the tree stand of FIG. 8.

The bottom wall 35 of vessel V slopes upwardly as it extends radially outwardly. A set of eight equally spaced ribs 36 are formed in the bottom wall, each rib being essentially in the form of an inverted channel as best seen in FIG. 4. The inner end of each rib 36 is joined directly to the bottom end of peg P, and the thickened wall portion 31 of the peg does not exist around the entire circumference of the peg, but only to fill in what would otherwise be a corner between the exterior wall surface of the peg and the upper and inner end of each of the ribs 36 (see FIG. 1). Vessel V also has a peripheral wall 37 which is of generally circular or cylindrical configuration, although as best seen in FIG. 3 there is some outward slope to the wall 37 as it extends upwardly. The top of the peripheral wall 37 terminates in a rounded rim portion 38, and then a circumferential flange or outer wall 39 extends downwardly by a considerable distance. The lower edge of the outer wall 39 is adapted to rest upon a floor or other flat supporting surface, see FIG. 3. A set of four flat fastening tabs 41 are spaced at equal intervals around the periphery of the bottom edge of the outer wall 39 and provide a means for nailing or otherwise fastening the tree stand 20 to a flat horizontal surface upon which it is supported. The radially inward edge of the bottom wall 35 is designated with numeral 42 as shown in FIG. 3, and its under surface lies at the same level as the under surface of the tabs 41, and hence rests upon the floor F or other flat supporting surface.

Intermediate each two of the radial ribs 36 is a small downwardly extending ridge 36a formed as a thickened portion of the bottom wall 35, as shown in FIG. 4. The ridges 36a and ribs 36 together provide rigidity to the bottom wall 35 of vessel V, and also add to the firm support of peg P.

FIG. 3 shows the tree stand 20 when filled with water W and supporting a tree trunk T. End surface 13 of the trunk is spaced a considerable distance above the ridges 36, and the water W therefore contacts the entire circumferential outer surface 12 and also the cut end of the wood grains on the bottom surface 13.

In the embodiment of FIGS. 1–6 the taper of peg P is preferably such that the ridges 28 on the exterior surface of the peg lie at an angle of seven degrees relative to the longitudinal axis of the peg. Thus, it is preferred that the angle of taper of the peg be precisely identical to the angle of taper of the hole H.

Figure 5:
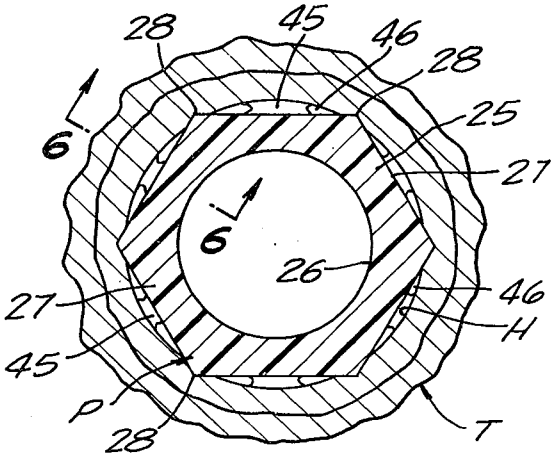
FIG. 5 is a cross-sectional view of the peg and tree trunk taken on the line 5—5 of FIG. 3.

As best seen in FIG. 5, the peg P is driven into the hole H sufficiently so that the ridges 28 bite into the wood of the hole wall. There are, however, intervening portions of the flat surfaces 27 which are not in engagement with the hole wall. Thus, between each flat surface 27 and the conical hole wall there is a space 45. This space 45 becomes filled with water, and as shown by arrows 46 in FIG. 6 the water moves upwardly in the edges of these spaces or channels. This upward movement of the water results in part from the hydraulic pressure from the body of water W in the liquid vessel, but it is also aided to a significant extent by capillary action.

It will be noted that the width of each space 45 at both of its lateral edges is very small, and then disappears entirely near the ridges 28 where the peg first merely engages the wood and then actually bites into it. Thus, the lateral edge boundaries of each space of passageway are infinitely small in width or thickness, because they are formed by a flat surface in conjunction with a concavely rounded surface whose degree of concavity is rather shallow. Therefore, a capillary action at the lateral edges of each space 45 is ensured, and will cause the water to rise upwardly inside the hole H not only to the level of the surface of the body of water W, but also to a higher level.

As best seen in FIG. 3, there is also a generally cylindrical space 47 above the upper end wall 29 of peg P within the upper extremity of hole H. This space is created deliberately. It is achieved by making the diameter of the truncated end of peg P somewhat larger than the diameter of the blunt end 18 of drill 17. Therefore, as the peg is driven inwardly into the hole H, and as ridges 28 cut into the side wall of the hole, the upward movement of the peg will be stopped by its ridges cutting into the side wall of the hole, rather than by reaching the end of the hole. Of course, in a more correct sense, the stand 20 is placed upon a floor or other flat supporting surface and the tree trunk T is lowered down upon it, receiving peg P within hole H. The dimensions, however, are such that the full length of the hole H is not occupied by the time that the trunk is firmly seated upon and supported by the peg.

By way of typical dimensions, the length of drill 17 beyond its stop shoulder 19 is about $3\frac{5}{8}$ inches, and the length of peg P is somewhat longer than that, with the length of the peg which enters the hole H being typically about $3\frac{3}{8}$ inches. Thus, the height of space 47 inside the hole and above the peg is about $\frac{1}{4}$ inch, or perhaps more, while the height of the space beneath the tree trunk bottom surface 13 and ribs 36 is of about the same magnitude.

MODIFIED PEG CONSTRUCTION

(FIG. 7)

Figure 7:
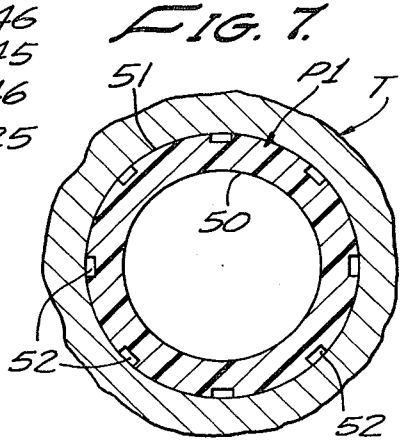
FIG. 7 is a view like FIG. 5, but showing a modified construction of the peg.

FIG. 7 illustrates a modified form of peg construction P1, in which both the interior wall 50 and the outer wall 51 are of conical configuration. Outer wall surface 51, however, has a plurality of longitudinal grooves 52 formed therein. While in the particular illustration the grooves are shown as being considerably narrower than the exterior wall space between the grooves, it may also be desirable to have the groove width be about equal to the intervening wall space, or even larger.

With the peg construction as shown in FIG. 7 the relatively raised longitudinal portions of the outer surface of the peg will not cut into the wooden wall of hole H, but may nevertheless compress the wood so as to provide a tight interfitting relationship.

Thus, while it is preferred to provide the exterior surface of the peg with actual ridges which will affirmatively cut into the wooden surface of the hole wall, it is also within the scope of the invention to provide a peg having an essential conical outer surface configuration and with longitudinal grooves provided therein for transporting the water upwardly into the hole H.

Alternatively, the peg may be made of strictly conical configuration, with an angle of taper identical to that of hole H, and its upper end truncated to a diameter greater than that of the end of the hole.

SECOND EMBODIMENT

(FIGS. 8–15)

Reference is now made to FIGS. 8–15, inclusive, illustrating a tree stand 60 in accordance with the present invention. Peg P2 is substantially identical with peg P of the first embodiment, except in the specific manner of the attachment of its lower end to the supporting base structure associated with the liquid vessel. The vessel V2 has a substantially flat circular bottom wall 62 (FIG. 11). Its peripheral wall is constructed in two separate parts, including a lower wall portion 65 which is substantially cylindrical and an upper wall portion 69 which flares somewhat outwardly.

The lower wall 65 of vessel V2 has four notches or recesses 66 formed in its outer surface, and which are equally circumferentially spaced about the vessel. The bottom wall 62 of the vessel is adapted to rest solidly upon a floor or other flat horizontal supporting surface, as clearly shown in FIG. 11. A set of four identical legs L are arranged in circumferentially equally spaced positions about the vessel V2, and extend radially outwardly therefrom, with each of the legs L being in engagement with the floor or other horizontal supporting surface throughout its length. Each of the legs L on its inner end has a fastening part 70 (FIG. 9) which fits into a corresponding recess 66 of the vessel wall in order to removably attach the leg to the vessel.

The flared or upper wall 69 of vessel V2 has, at its lower extremity, precisely the same diameter as the lower wall 65. Each of the recesses 66 in the lower wall is formed by making a corresponding inward protrusion 67 on the interior surface of the wall, since the entire wall 65 including the recesses thereof is made of a uniform thickness throughout. The upper wall portion 69 is also made of the same thickness, as best seen in FIG. 11. The walls of peg P2, including both the tapered hexagonal wall and the truncated upper end wall, are also made of the same thickness of material as walls 65 and 69. The vessel V2 and peg P2 are preferably integrally formed of plastic material.

The lower extremity of the hexagonal wall of peg P2 merges directly into the bottom wall 62 of the vessel. A more precise description of bottom wall 62, therefore, is that it is circular except for having a relatively shallow rectangular notch in its outer circumference at the location of each of the recesses 66, and with the further exception that it has a hexagonal opening at its center from which the peg P2 extends upwardly.

A set of four ribs 75 are also formed integrally with the vessel V2 and the peg P2. Each rib 75 on its radially inward end merges with the wall of peg P2 and on its radially outward end merges with the protrusion 67 in lower wall 65. Since the wall of vessel V2 is continuous, a small rectangular wall section 68, which is horizontally disposed, joins the upper extremity of each inward protrusion 67 with the lower extremity of the upper wall 69. See FIG. 11. Each radial rib 75 is of the same height as the inward wall protrusion 67, and also including the thickness of the horizontal wall section 68.

Thus the radial ribs 75 not only add to the strength of vessel V2 for supporting the body of water W therein, as shown in FIG. 11, but they also add significantly to the rigid support of the peg P2. In a functional sense the ribs 75 may be considered a part of the common base structure, along with the removable legs L, which supports both the vessel V2 and the peg P2. It is of interest to note in FIG. 10 that since peg P2 is hexagonal, and there are only four of the ribs 75, two of the ribs are joined to ridges on the peg while the other two ribs are joined to the centers of corresponding flat surfaces of the peg.

Each of the legs L in vertical cross-section, is of generally T-shaped configuration. An elongated flat strip 80 forms the upper part or arm of the T. Another elongated flat strip 81 is vertically disposed and forms the leg of the T. The inner end of the strip 81 is of a height nearly as great as that of the corresponding recess 66. See FIG. 11. The strip 81 diminishes to a relatively small height at the outer end of leg L, and hence the cover plate 80 of the leg L slopes downwardly to a corresponding extent. At the outer extremity of the leg a short section 82 of the cover plate is bent vertically downwardly to enclose the outermost extremity of the flat strip 81. As previously noted, the lower edge of the flat strip 81 engages the floor or other supporting surface, throughout its length.

The entire leg L including the strips 80, 81, 82 and the fastener parts 70, is preferably integrally formed of plastic material.

Each leg L is removably attached to the vessel V2 by means of a specially designed dovetail joint. Thus, the fastening part 70 is a solid member or body which is integrally formed with the T-structure of the peg (vertical strip 81 and horizontal strip 80) as a radially inward extension thereof. The height of the fastening part 70 is, very roughly speaking, about double its width measured circumferentially of the vessel V2. Its thickness in a direction radial to the vessel V2 is, again very roughly speaking, about half its width in the circumferential direction. However, the width of the fastening part 70 measured circumferentially of the vessel V2 is greater on its radially inward extremity that at the point where it joins the leg structure 80, 81. Thus when viewed in horizontal cross-section, as seen in both FIG. 12 and FIG. 13, its configuration is similar to that of a parallelogram. Furthermore, the width of the fastening part 70 measured circumferentially of vessel V2 is significantly greater at its bottom end than its top end.

The shape of recess 66 in lower wall 65 of vessel V2 corresponds to that of the fastening part 70. That is, its width measured in a direction circumferential to the vessel is greater at its bottom end than at its top end. Also, the side walls of each recess 66 do not lie radial to the vessel, nor parallel to each other, but diverge as they extend radially inwardly, as best seen in FIG. 13. As best seen in FIG. 13 the side walls which form the recess 66 are designated *66a* and *66b*, respectively, while the interior wall section that forms the radial interior of the recess is designated *66c*. Each of the interior wall sections *66c* is joined at its center by the associated rib 75. The interior surfaces of the wall section *66a, 66b, 66c* which together constitute the protrusion into the interior of the vessel V2 are collectively identified as the protrusion 67, as previously described.

The fastening part 70 of leg L is now more specifically described with reference to FIGS. 12, 13 and 14. At its upper extremity it includes a pair of small wings *71a, 71b* which are actually extensions of the T-arm 80, but on their radially inward edges are curved so as to matingly engage the circular outer surface of wall 65, as shown in FIG. 12. At its upper extremity the plug or central body portion of the fastening part 70 fits within the wall *66a, 66b, 66c* of recess 66, as shown in FIG. 12. At a lower elevation, shown in FIG. 13, the plug 70 has a hollow interior portion 72. It also has circumferential flanges *73a, 73b* which to some extent overlap the outer surface of the vessel wall 65.

Each leg is attached to the vessel V2 by laying the leg in its normal position on the floor or other supporting surface, and then lowering the vessel downwardly upon it. The reverse procedure is followed for detaching the leg.

FIG. 11 shows a tree trunk T being supported upon the stand 60. Water W contained within vessel V2 is in direct contact with the circumference of the trunk, as well as its cut lower end 13, and also flows upwardly into the hole H, just as in the first embodiment of the invention. As seen in FIG. 15 the relationship between peg P2 and hole H is the same as for the first embodiment. It will be noted, however, that the interior wall surface 77 of peg P2 is of hexagonal configuration, when viewed in cross-section, rather than circular or conical as in the interior wall of peg P of the first embodiment.

It will of course be understood that the functional operation of tree stand 60 constituting the second embodiment of the invention is substantially the same as for the first embodiment. However, there is a considerable saving of space when the tree stand is not in use, by simply detaching the legs L from the vessel V2. For this reason, the second embodiment is perhaps better suited for home or residential use, while the first embodiment may be preferred for institutional use, or for use in commercial lots where cut trees are displayed for purpose of sale.

THIRD EMBODIMENT

(FIGS. 16–18)

Reference is now made to FIGS. 16–18 illustrating a third, and considerably simplified, tree stand in accordance with the present invention. Rather than fabricate a base as a factory item, the base B3 is provided by utilizing a flat board, or a flat section of plywood, or any other readily available wooden support. The peg P3 is specifically designed for convenient securement to the wooden base.

Peg P3 includes a tapered hexagonal wall structure 101, which, as in the case of the previous embodiments, is preferably tapered with an included angle of 14 degrees so as to conform precisely to the angle of taper of the hole H in tree trunk T. Peg P3 also includes a circular pedestal 100 which is roughly twice the diameter of the lower end of the wall structure. The peg also includes a flat horizontal wall 102 forming its truncated upper end which, however, has a hole 103 formed therein. The interior of peg P3 is hollow, as in the previous embodiments. It is preferred to form the entire peg integrally as a single unit, including the pedestal 100, vertical wall 101, and upper end 102. Peg P3 may be made of rigid plastic material, or it may be preferred to construct it of metal, since it is designed to be used repeatedly and continuously over a long period of time.

A fastening bolt 105 is utilized for securing the peg P3 to the wooden base B3. Bolt 105 has a head 106 at its upper end which, when the bolt is inserted through the opening 103 in the top end of the peg, comes to rest upon and substantially fully covers the upper end wall 102 of the peg. At its lower end the bolt 105 has threads 107 which, as shown in FIG. 17, enter into an opening in the wooden base that is made for that purpose. In order to engage the threads, the bolt head 106 is preferably of hexagonal configuration, so that it may be drivingly rotated by means of a wrench or the like.

Alternatively, if desired, the bolt 105 may be provided with machine threads instead of the wood screw type of threads as presently illustrated. In that event a hole is drilled through the wooden base B3, a recess is cut on the underside of the base, and a nut is placed in that recess for purpose of securing the bolt.

As another alternative, the bolt 105 is not used at all, and the circular pedestal 100 of the peg P3 may be provided with a series of spaced openings through which small screws are inserted for purpose of fastening the peg to the wooden base. But in any event, the peg P3 is constructed as a separate unit, with a small but adequate supporting base of its own, and is designed to be removably attached to a larger wooden base which may then be obtained from whatever source is at hand.

The vessel V3, constructed integrally as a unit, has some similarity in appearance to a conventional cake pan. It includes a flat circular bottom wall 110. It also includes a peripheral wall 111 which is not vertical, but flares outwardly, as best seen in FIG. 17. The bottom wall 110 is not solid, however, but has a hexagonal central opening from which a tapered peg-shaped wall 112 extends upwardly. A horizontal wall section 113 closes the upper end of the peg-shaped wall 112.

Vessel V3 is adapted to be removably supported upon the peg P3 in secure interfitting relationship therewith. Hexagonal wall 112 of vessel V3 is then supported upon the hexagonal wall 101 of the peg P3, while the upper end wall 113 of the vessel is supported upon the head 106 of fastener 105. As shown in FIG. 17, tree trunk T is then positioned downwardly over the wall 112, 113 of the liquid vessel. The vessel is filled with water W.

As shown in FIG. 18, the ridges of the vessel wall 112, being firmly supported by the walls 101 of the peg, bite into the wooden wall of the hole H of trunk T. The functional operation is the same as in prior embodiments.

It is believed to be of some importance to have the horizontal wall section 113 included in the vessel V3, rather than have the upper extremity of the peg-shaped wall 112 be left opened. The reason is that water rising within the hole H of tree trunk T by capillary action will rise to a level higher than the surface of water W in the liquid vessel. If the upper end of the peg structure were left open, then water could run down through the hollow center of the peg, which would be undesired. The same consideration also applies to the previously described versions of the peg structure.

Vessel V3 is preferably made of thin walled plastic material, and is therefore extremely inexpensive. It may therefore be considered as a disposable item which is simply thrown away after a single use. It will be noted that the entire configuration of vessel V3 is such that a large number of such vessels can be nested together and placed within a relatively small container for purpose of storage or shipment.

Peg P3, by virtue of its construction, also requires very little storage space. A large number of these pegs may also be placed together in a nesting relationship and stored or shipped in a relatively small container. Depending upon the particular method of its construction, peg P3 may also be considered a disposable item. However, unlike the vessel V3, it must bear considerable weight in order to firmly support the tree.

In the present illustration as shown in FIG. 17 there is a significant vertical space between the bottom of vessel V3 and pedestal 100 of the peg. However, it may be preferred to construct the vessel so that its bottom wall 110 rests directly upon the pedestal 100, and in that event there is very little mechanical strength required for the wall structure of vessel V3, since the only thing that it directly supports is the body of water W, and for purposes of home use it may be preferred to keep the quantity of the water rather small.

ALTERNATE FORMS

While it is presently preferred to cut the hole H in the tree trunk T with an included angle of 14°, that is, an angle of 7° between the wall of the hole and its longitudinal axis, it will nevertheless be understood that a somewhat larger angle or a somewhat smaller angle may be utilized if desired. It is essential, however, that the angle of taper of the peg be substantially identical to the angle of taper of the hole, in order to provide a mechanically secure support for the tree trunk and hence the entire tree.

Since the cut lower end 13 of the tree trunk exposes the entire end grain of the wood to the body of water W, it is not absolutely necessary to have provision for the water to rise, either by gravity or capillary action, into the hole H. In that event the peg may be made of strictly conical configuration, with neither ridges nor depressions in its exterior surface. Secure support of the tree trunk is achieved by driving the wedge tightly into the hole.

It is, however, preferred to provide the external surface of the peg with depressions which then act as pathways through which the water can rise upwardly into the hole H. At least a portion of such pathways are preferably of small dimensions so that the water will rise by capillary action. When adding liquid nutrients, such as syrup, to the water, the capillary action can still be achieved and the life-giving benefits to the tree can be greatly increased.

According to the invention it is, however, preferred to provide the surface of the peg with at least three ridges, so that the ridges will rather readily bite into the surface of the wood when the peg is driven into the hole. The use of such ridges, at the same time, almost inevitably ensures that water passageways will also be available. While the present illustrations have emphasized a hexagonal configuration of the peg, the invention is not necessarily thus limited.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An integrally formed stand made of plastic material for supporting a tree and continuously supplying water thereto, comprising:

an upwardly opening vessel having a bottom wall and a peripheral wall, and having means associated with said bottom wall for firmly supporting said vessel upon a flat surface;

the central portion of said bottom wall being pushed upward to form a hollow tapered peg whose upper end is enclosed, the circumferential outer surface of said peg not being precisely circular but having relatively raised and lowered portions, said raised portions forming longitudinally extending ridges that may engage the interior wall of a conical hole that is cut in the lower end of the tree trunk for firmly supporting the tree while said lowered surface portions of said peg provide pathways for upward flow of the water along the interior wall of the hole;

the plastic wall of the bottom end portion of said peg being thickened to provide a rigid support; and said bottom wall of said vessel having a plurality of ribs therein formed integral with said peg and extending radially outwardly therefrom for rigidly supporting the same.

2. The device of claim 1 wherein the surface of said peg is of polygonal cross-sectional configuration.

3. The device of claim 1 wherein said bottom wall of said vessel slopes upwardly as it extends radially outwardly to join said peripheral wall, said peripheral wall also having a downwardly turned exterior flange which terminates at the level of the under surface of the central part of said bottom wall.

4. In combination with a live tree whose trunk has been cut from its roots and which has a conical hole drilled into the cut end of the trunk, apparatus for supporting the tree and providing water and liquid nutrients thereto, said apparatus comprising:

an open liquid vessel having means for supporting the same upon a flat surface;

a tapered peg having its larger end extending downwardly into and secured within said vessel, said peg having at least three longitudinally extending ridges formed on the tapered surface thereof;

said vessel and said peg being integrally formed of plastic material, and said peg being hollow and having a flat upper end wall forming a truncated upper end but without providing a passageway to the hollow interior thereof;

the tree trunk being pushed downwardly upon said peg so that said peg is received within said hole and said ridges bite into said hole wall in supporting engagement therewith, and the cut end of the trunk is suspended above the bottom wall of said vessel; and a body of liquid disposed within said vessel and extending into direct contact with both the cut end of the tree trunk and the outer circumferential surface of the lower end portion thereof.

5. Apparatus for supporting and providing water to a living tree whose trunk has been cut from its roots, said apparatus comprising, in combination:

a supporting base;

a tapered peg having its lower end firmly secured to said base, and extending vertically upwardly therefrom;

an upwardly opening vessel which is integrally formed from thin-walled material having a generally flat bottom wall and a generally vertical peripheral wall, with the central portion of said bottom wall being formed into an upwardly extending, tapered, hollow post whose upper end is closed and whose interior surface conforms at least approximately to the shape of the exterior surface of said peg, the exterior surface of said post having at least three longitudinally extending ridges thereon; and said vessel being disposed upon said base with said post thereof encircling and resting upon said peg;

whereby said vessel may be at least partially filled with water, a conical hole may be drilled into the cut end of the tree trunk, and the cut end of the tree trunk may then be inserted within said vessel with the hole thereof being occupied by said peg and said post.

6. Apparatus as in claim 5 wherein said vessel is made of thin-walled plastic material with its outer circumferential wall being outwardly flared, whereby a number of said vessels may be placed in a nesting relationship for purpose of storage or transportation.

7. Apparatus as in claim 5 wherein said base is a flat wooden member, said peg is made with a hollow interior and has a truncated upper end with an opening therein and also has an outwardly turned circumferential flange on its lower end, and wherein said securing means includes an elongated fastener having a head portion on its upper end, said fastener extending downward through said hollow interior of said peg, and the lower end of said fastener being threadedly secured within said wooden base member.

8. Apparatus as in claim 5 wherein said peg has a cross-sectional configuration which is non-circular, with some relatively raised portions forming longitudinal ridges thereon, and some relatively lowered portions between the ridges conforming to the internal configuration of said post.

9. Apparatus as in claim 5 wherein said peg is of polygonal configuration and said hollow post is of the same polygonal configuration.

* * * * *